US008404063B2

(12) United States Patent
Shimano et al.

(10) Patent No.: US 8,404,063 B2
(45) Date of Patent: Mar. 26, 2013

(54) PROCESS FOR PRODUCTION OF INORGANIC FIBER MATS

(75) Inventors: Shozo Shimano, Tokyo (JP); Takashi Mashimo, Tokyo (JP); Koichi Shimeno, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 351 days.

(21) Appl. No.: 12/810,344

(22) PCT Filed: Dec. 25, 2008

(86) PCT No.: PCT/JP2008/073517

§ 371 (c)(1),
(2), (4) Date: Jun. 24, 2010

(87) PCT Pub. No.: WO2009/081960

PCT Pub. Date: Jul. 2, 2009

(65) Prior Publication Data

US 2010/0288427 A1 Nov. 18, 2010

(30) Foreign Application Priority Data

Dec. 26, 2007 (JP) ..... 2007-333466

(51) Int. Cl.
*B05D 1/02* (2006.01)
*B32B 17/04* (2006.01)
*B05B 1/12* (2006.01)

(52) U.S. Cl. ..... 156/62.2; 264/128

(58) Field of Classification Search ..... 156/62.2, 156/62.4, 180, 181, 285; 264/115, 128; 427/294, 427/350, 421.1, 424

See application file for complete search history.

(56) References Cited

U.S. PATENT DOCUMENTS 4,472,165 A * 9/1984 Gregorian et al. ..... 8/115.7

(Continued)

FOREIGN PATENT DOCUMENTS

GB 1 311 619 3/1973
JP 1-152762 A 10/1989

(Continued)

OTHER PUBLICATIONS

Abstract and Machine Translation of JP 2007-092822 A. Date Unknown.*

(Continued)

*Primary Examiner* — Michael Tolin
(74) *Attorney, Agent, or Firm* — Holtz Holtz Goodman & Chick PC

(57) ABSTRACT

Provided is a method of producing an inorganic fiber mat, the method enabling efficient adhesion of an aldehyde scavenger to an inorganic fiber mat while preventing the aldehyde scavenger from scattering around. The method of producing an inorganic fiber mat includes a fiber collection step of applying a binder to inorganic fibers and accumulating in a mat-like shape on a conveyor line to form an inorganic fiber web, a binder-curing step of heat-curing the binder applied to the inorganic fiber web to form an inorganic fiber mat, and an aldehyde scavenger application step of applying an aldehyde scavenger to the inorganic fiber mat, in which the aldehyde scavenger application step involves spraying the aldehyde scavenger in a form of droplets having an average diameter of 1 to 50 μm on a front side of the inorganic fiber mat and sucking from a back side of the inorganic fiber mat.

17 Claims, 3 Drawing Sheets

U.S. PATENT DOCUMENTS

| | | | | | |
|---|---|---|---|---|---|
| 4,980,205 | A | * | 12/1990 | Haskell | 427/294 |
| 5,690,740 | A | * | 11/1997 | Smith | 118/300 |

FOREIGN PATENT DOCUMENTS

| | | | |
|---|---|---|---|
| JP | 03-178367 | A | 8/1991 |
| JP | 2004-210558 | A | 7/2004 |
| JP | 2006-028366 | A | 2/2006 |
| JP | 2007-092822 | A | 4/2007 |
| JP | 2008-075038 | A | 4/2008 |

OTHER PUBLICATIONS

Achim Lunenschloss; Wilhelm Albrecht: "Vliesstoffe", 1982, Georg Thieme Verlag Stuttgart, New York, Stuttgart, XP002612689, ISBN: 3-13-609401-8, pp. 188-190.

Wilhelm Albrecht, Hilmar Fuchs, Walter Kittelmann: "Nonwoven Fabrics", 2003, Wiley—VCH, Weinheim, XP002612690, ISBN: 3-527-30406-1, p. 382, paragraph 3—p. 383.

* cited by examiner

PROCESS FOR PRODUCTION OF INORGANIC FIBER MATS

This application is the U.S. national phase application of International Application PCT/JP2008/073517 filed Dec. 25, 2008.

TECHNICAL FIELD

The present invention relates to a method of producing an inorganic fiber mat capable of suppressing release of aldehydes.

BACKGROUND ART

In an inorganic fiber mat made of an inorganic fiber such as glass wool or rock wool, a phenolic resin binder containing as a main component a phenol-formaldehyde resin (or resol-type phenolic resin) has been widely used as a binder for bonding fibers with each other. The phenolic resin binder described above is heat-cured within a relatively short time to provide a cured product having strength, and hence the inorganic fiber mats using the phenolic resin binder are excellent in performance such as shape retention, thickness restoring property after opening compression baling, or deflection resistance.

However, formaldehyde is released from the inorganic fiber mat using the phenolic resin binder during the production process, particularly at the time of binder curing. Thus, treating or coping with the released formaldehyde remains as a problem. In recent years, restriction of the amount of formaldehyde emission by laws and regulations or the like has been particularly demanded from the viewpoint of reducing environmental load.

In order to suppress emission of aldehydes released from an inorganic fiber mat, there is a method of applying an aldehyde scavenger to an inorganic fiber mat after binder curing. Patent Document 1 discloses a method of producing an inorganic fiber heat insulating material, the method including a fiber collection step of adding a binder to inorganic fibers and accumulating in a mat-like shape to form an inorganic fiber web, a curing step of curing the binder on the inorganic fiber web to form an inorganic fiber mat, and a step of spraying and applying a solution of a formaldehyde scavenger as mist-like droplets having an average diameter of 1 to 20 μm to the inorganic fibers in a mat-like shape after the fiber collection step.

Patent Document 1: JP 2007-92822 A

DISCLOSURE OF THE INVENTION

Problems to be Solved by the Invention

As disclosed in the above-mentioned Patent Document 1, spraying an aldehyde scavenger in a mist-like state enables nearly uniform application on the surface of an inorganic fiber mat and enables a reduction in the time necessary for drying the aldehyde scavenger.

However, spraying the aldehyde scavenger in a mist-like state results in that the amount of the aldehyde scavenger scattering around be larger than the amount of the aldehyde scavenger adhered to the inorganic fiber mat. Thus, there remained a problem that surrounding equipment was polluted with the scattered aldehyde scavenger and a problem that a working environment was damaged. Further, there remained a problem that productivity declined because of the larger usage of the aldehyde scavenger.

Thus, an object of the present invention is to provide a method of producing an inorganic fiber mat, the method enabling efficient adhesion of an aldehyde scavenger to an inorganic fiber mat while preventing the aldehyde scavenger from scattering around.

Means for Solving the Problems

In order to achieve the above-mentioned object, a method of producing an inorganic fiber mat of the present invention includes a fiber collection step of applying a binder to inorganic fibers and accumulating in a mat-like shape on a conveyor line to form an inorganic fiber web, a binder-curing step of heat-curing the binder applied to the inorganic fiber web to form an inorganic fiber mat, and an aldehyde scavenger application step of applying an aldehyde scavenger to the inorganic fiber mat, in which the aldehyde scavenger application step involves spraying the aldehyde scavenger in a form of droplets having an average diameter of 1 to 50 μm on a front side of the inorganic fiber mat and sucking from a back side of the inorganic fiber mat.

According to the method of producing an inorganic fiber mat of the present invention, the aldehyde scavenger is sprayed in a form of droplets having an average diameter of 1 to 50 μm on the front side of the inorganic fiber mat, and hence the aldehyde scavenger is applied nearly uniformly on the front side of the inorganic fiber mat. In addition, by adopting a manner in which the aldehyde scavenger is sucked from the back side of the inorganic fiber mat, the aldehyde scavenger can be sufficiently permeated into the inside of the inorganic fiber mat while scattering of the aldehyde scavenger into the surrounding environment is prevented. Thus, according to the present invention, the aldehyde scavenger is not scattered around and the aldehyde scavenger can efficiently adhere to the inorganic fiber mat. As a result, an inorganic fiber mat capable of suppressing release of aldehydes can be produced with high productivity.

A method of producing an inorganic fiber mat of the present invention preferably includes spraying the aldehyde scavenger on the front side of the inorganic fiber mat on the conveyor line immediately after the binder-curing step and sucking from the back side of the inorganic fiber mat in a downstream side of the site where the spraying is performed. The inorganic fiber mat immediately after the binder-curing step has residual heat. Thus, the aldehyde scavenger is sprayed on the front side of the inorganic fiber mat, and then the residual heat can be taken advantage of, to thereby promote drying of the aldehyde scavenger, resulting in a reduction in the time of drying the aldehyde scavenger. Meanwhile, conveyance of the inorganic fiber mat involves occurrence of air turbulence, and the aldehyde scavenger is scattered in some cases particularly in the downstream side of the site where the aldehyde scavenger is sprayed. Even in such cases, by sucking from the back side of the inorganic fiber mat in the downstream side of a site where the aldehyde scavenger is sprayed, more effective prevention of scattering of the aldehyde scavenger into the surrounding environment is possible.

A method of producing an inorganic fiber mat of the present invention preferably includes, in the aldehyde scavenger application step, forming an air curtain by blowing a gas on the front side of the inorganic fiber mat in an upstream side of the site where the aldehyde scavenger is sprayed on the conveyor line for the inorganic fiber mat. According to this aspect, the above-mentioned air curtain can prevent more effectively a scattered aldehyde scavenger from adhering to machines or devices used in the curing step, such as a heating furnace.

A method of producing an inorganic fiber mat of the present invention preferably includes, in the aldehyde scavenger application step, forming an air curtain by blowing a gas on the front side of the inorganic fiber mat in a downstream side of the site where the aldehyde scavenger is sprayed on the conveyor line for the inorganic fiber mat. According to this aspect, the above-mentioned air curtain can prevent more effectively a scattered aldehyde scavenger from adhering to machines or devices provided for steps after the aldehyde scavenger application step, such as a cutting device for an inorganic fiber mat, a packaging machine, and a surface material-bonding device.

A method of producing an inorganic fiber mat of the present invention preferably includes, in the aldehyde scavenger application step, performing suction from the back side of the inorganic fiber mat just below a site where the air curtain is formed by blowing the gas on the front side of the inorganic fiber mat. According to this aspect, the aldehyde scavenger can be prevented more effectively from scattering around.

A method of producing an inorganic fiber mat of the present invention preferably includes, in the aldehyde scavenger application step, forming the air curtain by blowing hot air on the front side of the inorganic fiber mat. According to this aspect, the above-mentioned hot air can dry the aldehyde scavenger adhered to the inorganic fiber mat, resulting in a significant reduction in the time of drying the aldehyde scavenger.

A method of producing an inorganic fiber mat of the present invention preferably includes, in the aldehyde scavenger application step, applying the aldehyde scavenger in a state where partition plates are arranged along both side edge portions of the conveyor line for the inorganic fiber mat. According to this aspect, the partition plates can prevent the aldehyde scavenger from scattering into the surrounding environment. Further, a residing portion of the aldehyde scavenger in the upper space of the inorganic fiber mat on which the aldehyde scavenger was sprayed can also be sucked from the back side of the inorganic fiber mat and can be permeated into the inside of the inorganic fiber mat. As a result, the ratio in adhesion of the aldehyde scavenger is improved.

In a method of producing an inorganic fiber mat of the present invention, it is preferred that an aqueous composition having a solid content of 5 to 40% be used as the aldehyde scavenger. According to this aspect, spray nozzles rarely clog, and the aldehyde scavenger can be used with a viscosity which is suitable for easily spraying on the inorganic fiber mat, and hence the aldehyde scavenger can be prevented from scattering around a conveyor line. As a result, the inorganic fiber mat can be produced in a more stable manner.

Effects of the Invention

According to the present invention, the aldehyde scavenger is not scattered around and the aldehyde scavenger can efficiently adhere to the inorganic fiber mat. As a result, an inorganic fiber mat capable of suppressing release of aldehydes can be produced with high productivity.

BEST MODE FOR CARRYING OUT THE INVENTION

A method of producing an inorganic fiber mat of the present invention includes steps involving a fiber collection step of applying a binder to inorganic fibers and accumulating in a mat-like shape on a conveyor line to form an inorganic fiber web, a binder-curing step of heat-curing the binder of the inorganic fiber web to form an inorganic fiber mat, and an aldehyde scavenger application step of applying an aldehyde scavenger to the inorganic fiber mat. A feature of the present invention is that the above-mentioned aldehyde scavenger application step involves spraying the aldehyde scavenger in the form of droplets having an average diameter of 1 to 50 μm on the front side of the inorganic fiber mat and sucking from the back side of the inorganic fiber mat.

Hereinafter, each step of the method of producing an inorganic fiber mat of the present invention is described.

(Fiber Collection Step)

In the fiber collection step, inorganic fibers made from a molten inorganic material using a fiber-making machine are applied with a binder, and accumulated in a mat-like shape on a porous conveyor line, to thereby form an inorganic fiber web.

Glass wool, rock wool, or the like can be used as an inorganic fiber without any particular limitation. Various methods such as a flame method, a blowing method, and a centrifugation method (often called a rotary method) can be used for making inorganic fibers. In particular, the centrifugation method is recommended in the case of using glass wool as the inorganic fiber.

A binder applied to the inorganic fiber is not particularly limited as long as the binder is excellent in wettability and adhesiveness to the inorganic fiber before curing and is excellent in bonding capability to the inorganic fiber after curing, and the cured product has water resistance, humidity resistance, noncombustibility, or the like. Preferred examples of the binder include a binder containing an aldehyde-condensing thermosetting resin such as a resol-type phenolic resin, a resol-type phenol-urea resin, or a melamine-urea resin. It should be noted that the aldehyde-condensing thermosetting resin produces formaldehyde during its curing process.

The binder can be applied to the inorganic fiber by coating or spraying using a spraying machine, or the like. The amount of the binder applied varies depending on the density or applications of the target inorganic fiber mat. Based on the mass of the inorganic fiber mat to which the binder is applied, the amount of the binder applied falls, in terms of the solid content, preferably in the range of 0.5 to 15 mass %, or more preferably in the range of 0.5 to 9 mass %.

The timing when the binder is applied to the inorganic fiber is not limited as long as it is the timing after the fiber is made. That is, a binder may be applied immediately after inorganic fibers are made and then the inorganic fibers to which the binder is applied may be accumulated in a mat-like shape on a conveyor line. Alternatively, inorganic fibers to which a binder is not applied may be accumulated in a mat-like shape on a conveyor line to form an inorganic fiber web, to which the binder then may be applied.

When the inorganic fibers are accumulated on the conveyor line, it is preferred that the inorganic fibers be accumulated while the inorganic fibers are being sucked with a suction device from the opposite side of the surface of the conveyor line on which the inorganic fibers are accumulated. Accordingly, the inorganic fibers can be collected efficiently on the conveyor line.

(Binder-Curing Step)

In the binder-curing step, the inorganic fiber web formed in the fiber collection step is fed to a porous conveyor or the like that is formed in a pair arrangement upward and downward with a certain distance to thereby compress the inorganic fiber web so that the inorganic fiber web has a desired thickness. The compressed inorganic fiber web is conveyed and introduced into a heating furnace or the like while being in a state compressed with the desired thickness, and the binder adhered to the inorganic fiber web is heat-cured, to thereby form the inorganic fiber mat.

The temperature at which the binder is cured is not particularly limited, and is preferably 180 to 250° C. Meanwhile, the heating time is appropriately selected from the range of 30 seconds to 10 minutes depending on the density and thickness of the inorganic fiber mat.

(Aldehyde Scavenger Application Step)

In the aldehyde scavenger application step, an aldehyde scavenger is applied on the front side of the inorganic fiber mat in which the binder is cured in the binder-curing step.

In the present invention, the aldehyde scavenger application step involves spraying the aldehyde scavenger in the form of droplets having an average diameter of 1 to 50 μm on the front side of the inorganic fiber mat, and sucking from the back side of the inorganic fiber mat.

FIG. 1 and FIG. 2 are used to describe the aldehyde scavenger application step in more detail. FIG. 1 is a perspective view of an aldehyde scavenger application device used in the aldehyde scavenger application step. FIG. 2 is a front view of the aldehyde scavenger application device.

As illustrated in FIG. 1 and FIG. 2, in the aldehyde scavenger application device, a porous conveyor line 3 for conveying an inorganic fiber mat 2 in which a binder is cured stretches from a heating furnace 1 that is used in the binder-curing step.

Spray nozzles 4 for spraying the aldehyde scavenger to the inorganic fiber mat 2 placed on the conveyor line 3 are arranged above the conveyor line 3.

The spray nozzles 4 are not particularly limited as long as the spray nozzles can spray the aldehyde scavenger in the form of mist-like droplets having an average diameter of 1 to 50 μm. Such spray nozzles are commercially available, and include "BIMV8004", "BIMV80075", "BIMV11004", and "BIMV110075", which are on the market through H. IKEUCHI Co., LTD.

The spray nozzle 4 preferably has a discharge opening disposed at a place which is distant from a front surface 2*a* of the inorganic fiber mat on the conveyor line 3 by 100 to 400 mm, or more preferably has a discharge opening positioned at a place distant from the front surface 2*a* of the inorganic fiber mat by 100 to 300 mm. If the distance between the discharge opening of the spray nozzle 4 and the front surface 2*a* of the inorganic fiber mat on the conveyor line 3 is less than 100 mm, the aldehyde scavenger cannot be applied uniformly on the front side of the inorganic fiber mat in some cases. Meanwhile, if the distance exceeds 400 mm, the aldehyde scavenger scatters around in much more amounts.

The discharge opening of the spray nozzle 4 preferably leans by 0 to 60° toward the direction in which the inorganic fiber mat is forwarded when the downward direction in which the discharge opening is positioned vertically is defined as 0°. Leaning the discharge opening of the spray nozzle by 0 to 60° toward the direction in which the inorganic fiber mat is forwarded leads to the increased area of the inorganic fiber mat to which the aldehyde scavenger is applied, resulting in better application efficiency. Further, when the line speed of the conveyor line 3 exceeds 50 m/min, the discharge opening leans preferably by 0 to 45°, or more preferably by 0 to 15°. Meanwhile, when the line speed of the conveyor line 3 is equal to or below 50 m/min, the discharge opening leans preferably by 15 to 45°, or more preferably by 15 to 30°.

Above the conveyor line 3 and in the downstream side of the spray nozzles 4, there are arranged air nozzles 5*a* and 5*b* for forming an air curtain by blowing air to the inorganic fiber mat on the conveyor line 3. As the air nozzle, it is particularly preferred to have a structure in which hot air is blown. It should be noted that two air nozzles are arranged in this embodiment, but one air nozzle may be arranged, or two or more air nozzles may be arranged, and the number of is not particularly limited.

The air nozzle preferably has a discharge opening disposed at a place which is distant from the front surface 2*a* of the inorganic fiber mat on the conveyor line 3 by 50 to 400 mm, or more preferably has a discharge opening positioned at a place distant from the front surface 2*a* of the inorganic fiber mat by 100 to 250 mm. This is because if the distance between the discharge opening of the air nozzle and the front surface 2*a* of the inorganic fiber mat on the conveyor line 3 is less than 50 mm, in the case where the inorganic fiber mat moves upwardly and downwardly while the inorganic fiber mat is moving on the conveyor line, the discharge opening of the air nozzle touches the inorganic fiber mat in some cases, which becomes an obstacle for the production of the inorganic fiber mat. Meanwhile, if the distance exceeds 400 mm, the preventing effect of the air curtain on the scattering of the aldehyde scavenger is not sufficiently exerted in some cases.

The discharge opening of the air nozzle leans preferably by 0 to 60° toward the direction in which the inorganic fiber mat is forwarded when the downward direction in which the discharge opening is positioned vertically is defined as 0°, or leans more preferably by 30 to 45°. Leaning the discharge opening of the air nozzle by 0 to 60° toward the direction in which the inorganic fiber mat is forwarded leads to the increased area of the inorganic fiber mat to which air is blown, with the result that the scavenger can be inhibited from floating above the conveyor line.

Below the conveyor line 3 and in the downstream side of a site A where the aldehyde scavenger is sprayed to the inorganic fiber mat 2 on the conveyor line 3, there is provided a suction device 6. It is preferred that the suction device 6 be arranged so that the suction device can perform suction from the back surface 2*a* of the inorganic fiber mat 2 even immediately below a site B1 and a site B2 where the air nozzles 5*a* and 5*b* blow air to the inorganic fiber mat 2. One suction device 6 is provided in this embodiment, but multiple suction devices may be provided. It should be noted that when multiple suction devices are provided, the multiple suction devices are not provided preferably in the upstream side of the site A where the aldehyde scavenger is sprayed. The inorganic fiber mat immediately after the binder-curing step has residual heat because the inorganic fiber mat is heated when the binder is cured. Thus, the aldehyde scavenger is sprayed to the inorganic fiber mat with the residual heat, and then the residual heat can be taken advantage of, to thereby dry the aldehyde scavenger adhered to the inorganic fiber mat, resulting in a significant reduction, for example, in the drying time of the aldehyde scavenger. This is because if suction operation is performed in the upstream side of the site A where the aldehyde scavenger is sprayed, the inorganic fiber mat will be cooled, and drying by taking advantage of the residual heat is not conducted, with the result that the cost and time necessary for drying the aldehyde scavenger adhered to the inorganic fiber mat may be increased.

Partition plates 7 are arranged along both side edge portions of the conveyor line 3.

In the aldehyde scavenger application step, the aldehyde scavenger in the form of droplets having an average diameter of 1 to 50 μm is sprayed from the spray nozzles 4 on the front surface 2*a* of the inorganic fiber mat 2 while the inorganic fiber mat is being conveyed on the conveyor line 3, to thereby cause the aldehyde scavenger to adhere on the front surface 2*a* of the inorganic fiber mat 2. Further, the suction device 6 is activated to perform suction operation from a back surface 2*b* of the inorganic fiber mat in the downstream side of the site A where the aldehyde scavenger is sprayed. In addition, air is blown from the air nozzles 5*a* and 5*b* on the front surface 2*a* of the inorganic fiber mat in the downstream side of the site A where the aldehyde scavenger is sprayed, to thereby form the air curtain.

When the aldehyde scavenger is sprayed in a mist-like state, the whole amount of the aldehyde scavenger sprayed is too much to adhere to the inorganic fiber mat 2, and some amount thereof resides near the site A where spraying is performed. Then, conveyance of the inorganic fiber mat 2 involves occurrence of air turbulence, and the aldehyde scavenger is scattered particularly into the downstream side of the site A where the aldehyde scavenger is sprayed. In such case, the aldehyde scavenger is sucked with the suction device 6 from the back surface 2*b* of the inorganic fiber mat in the downstream side of the site A where the aldehyde scavenger is sprayed, and hence the aldehyde scavenger residing above the suction device 6 is sucked. Thus, the aldehyde scavenger does not easily scatter around, and the aldehyde scavenger can be permeated into the inside of the inorganic fiber mat 2. As a result, the ratio in adhesion of the aldehyde scavenger is improved.

Besides, in the downstream side of the site A where the aldehyde scavenger is sprayed, air is blown from the air nozzles 5*a* and 5*b* on the front surface 2*a* of the inorganic fiber mat to form an air curtain 8. The air curtain then blocks the movement of the aldehyde scavenger, resulting in the difficulty in scattering of the aldehyde scavenger. Further, the air blowing causes the permeation of the aldehyde scavenger adhered to the surface of the inorganic fiber mat 2 into the inside of the inorganic fiber mat. As a result, the efficiency in adhesion of the aldehyde scavenger is improved.

The average diameter of the droplets of the aldehyde scavenger sprayed from the spray nozzles 4 needs to be 1 to 50 μm, and is preferably 5 to 30 μm, or is more preferably 10 to 20 μm. If the average diameter of the droplets of the aldehyde scavenger is less than 1 μm, the aldehyde scavenger scatters around because of the influence of the ambient air, and it becomes difficult for the aldehyde scavenger to adhere to the inorganic fiber mat. Meanwhile, if the average diameter of the droplets exceeds 50 μm, it takes a longer time to dry the aldehyde scavenger, and the aldehyde scavenger is not permeated sufficiently into the inside of the inorganic fibermat in some cases. It should be noted that the average diameter of the droplets of the aldehyde scavenger can be measured by a liquid immersion method, a laser diffraction method, another laser diffraction method, or the like, the liquid immersion method being performed by spraying an aldehyde scavenger on a plate glass coated with a silicon oil or the like and measuring the diameter of particles in the silicon oil, the laser diffraction method utilizing the Fraunhofer diffraction being performed by spraying a formaldehyde scavenger on a laser light path and measuring the intensity of scattered light scattering on the surfaces of particles in the light path, and the another laser diffraction method utilizing the Doppler method being performed by forming interference fringes by crossing two laser lights, spraying a formaldehyde scavenger to the interference fringes, and measuring scattered light caused by particles passing through the interference fringes in terms of the phase shift when sensing with an optical receiver.

Suction from the suction device 6 is preferably performed at an air velocity of 0.1 to 3.4 m/sec and in an air volume of 1 to 8 $m^3$/sec based under the state where the inorganic fiber mat is not placed on the conveyor line 3. The values below the lower limits of the above-mentioned ranges of the air velocity and air volume are not preferred because suction is not performed sufficiently, a larger amount of the aldehyde scavenger floats up, and the scattering amount of the aldehyde scavenger becomes much more. Meanwhile, the values above the upper limits are not preferred because the inorganic fiber mat is pulled too strongly at a sucking portion, the movement of the inorganic fiber mat is disturbed, and the inorganic fiber mat may probably stay at the sucking portion, with the result that the production of the inorganic fiber mat is disturbed.

When an air curtain is formed on the front side of the inorganic fiber mat, hot air is blown from the air nozzles 5*a* and 5*b* to form the air curtain, which can promote the drying of the aldehyde scavenger and can reduce more effectively the drying time of the aldehyde scavenger.

The adhesion amount of the aldehyde scavenger is preferably 1 to 60 g/$m^2$ in terms of liquid amount with respect to the surface area of the inorganic fiber mat 2.

The aldehyde scavenger to be applied to the inorganic fiber mat is not particularly limited as long as the aldehyde scavenger is a substance that reacts with aldehydes to produce stable compounds, is dissolved or dispersed in a solvent such as water or an alcohol, and forms a solution which can be sprayed. Examples of the substance include sodium sulfite, potassium sulfite, calcium sulfite, sodium hydrogen sulfite, potassium hydrogen sulfite, calcium hydrogen sulfite, sodium dithionite, potassium dithionite, calcium dithionite, sodium disulfite, potassium disulfite, calcium disulfite, ammonium sulfite, amidosulfonic acid, ammonium amidosulfate, urea, ethylene urea, dihydroxy ethylene urea, dicyandiamide, cyanoacetamide, diethylenetriamine, dihydrazide adipate, succinimide, carbodihydrazide, and dihydrazide succinate. Any of those substances is preferably used to prepare an aqueous composition having a solid content of 5 to 40% and having a pH from mildly acidic to mildly alkaline (pH of about 5 to 9).

In order to suppress the release of aldehydes from the inorganic fiber mat obtained by the production method of the present invention, in particular, more preferred is an aldehyde scavenger formed of a combination of carbodihydrazide and at least one kind selected from dihydrazide adipate, dihydrazide succinate, sodium sulfite, and sodium hydrogen sulfite.

The above-mentioned dihydrazide adipate, dihydrazide succinate, sodium sulfite, and sodium hydrogen sulfite are more preferably contained, with respect to 100 parts by mass of carbodihydrazide, in the ratios of 5 to 60 parts by mass of dihydrazide adipate, 5 to 40 parts by mass of dihydrazide succinate, 0 to 5 parts by mass of sodium sulfite, and 0 to 5 parts by mass of sodium hydrogen sulfite.

In addition, still more preferred is an aldehyde scavenger formed of a combination of carbodihydrazide, dihydrazide adipate and/or dihydrazide succinate, and sodium sulfite and/or sodium hydrogen sulfite. In this case, the above-mentioned dihydrazide adipate and/or dihydrazide succinate and the above-mentioned sodium sulfite and/or sodium hydrogen sulfite are most preferably contained in the aldehyde scavenger, with respect to 100 parts by mass of carbodihydrazide, in the ratio of 5 to 19 parts by mass of dihydrazide adipate and/or dihydrazide succinate, and in the ratio of 0.1 to 5 parts by mass of sodium sulfite and/or sodium hydrogen sulfite.

The inorganic fiber mat applied with the aldehyde scavenger in the aldehyde scavenger application step as described above is subjected to a drying treatment in the next step if required, followed by cutting in a predetermined length, to thereby yield a final product. Alternatively, an inorganic fibermat with a surface material bonded may be produced by bonding a surface material with an adhesive or the like on at least one surface of an inorganic fiber mat. It is possible to use, as the surface material, paper, a synthetic resin film, a metal foil film, a nonwoven fabric, a woven fabric, or a combination thereof.

A second embodiment of a method of producing an inorganic fiber mat of the present invention is described by using FIG. 3. It should be noted that the second embodiment is the same as the above-mentioned embodiment except the aldehyde scavenger application step, and hence the description of the second embodiment except an aldehyde scavenger application step is omitted.

An aldehyde scavenger application device used in this embodiment is different from that in the above-mentioned embodiment in the respect that second air nozzles 9 are further arranged in the upstream side of spray nozzles 4.

It is preferred that the second air nozzles 9 be constituted so that an air curtain is formed by blowing hot air on the front side of the inorganic fiber mat 2. According to this embodiment, because the inorganic fiber mat is preliminarily heated, the drying of the aldehyde scavenger sprayed on the front side of the inorganic fiber mat can be performed within a shorter time.

The second air nozzle 9 preferably has a discharge opening disposed at a place which is distant from the front surface 2*a* of the inorganic fiber mat on the conveyor line 3 by 50 to 400 mm, or more preferably has a discharge opening positioned at a place distant from the front surface 2*a* of the inorganic fiber mat by 100 to 250 mm. This is because if the distance between the discharge opening of the second air nozzle 9 and the front surface 2*a* of the inorganic fiber mat on the conveyor line 3 is less than 50 mm, in the case where the inorganic fiber mat moves upwardly and downwardly while the inorganic fiber mat is moving on the conveyor line, the discharge opening of the air nozzle touches the inorganic fiber mat in some cases, which becomes an obstacle for the production of the inorganic fiber mat. Meanwhile, if the distance exceeds 400 mm, the preventing effect of the air curtain on the scattering of the aldehyde scavenger is not sufficiently exerted in some cases.

The discharge opening of the second air nozzle leans preferably by 0 to 60° toward the direction in which the inorganic fiber mat is forwarded when the downward direction in which the discharge opening is positioned vertically is defined as 0°, or leans more preferably by 30 to 45°. Leaning the discharge opening of the second air nozzle by 0 to 60° toward the direction in which the inorganic fiber mat is forwarded leads to the increased area of the inorganic fiber mat to which air is blown, with the result that the scavenger can be inhibited from floating above the conveyor line.

In this embodiment, the second air nozzles 9 are arranged in the upstream side of the spray nozzles 4 so that another air curtain is formed in the upstream side of the site where the aldehyde scavenger is sprayed. Thus, the air curtain can prevent the aldehyde scavenger from flowing into the heating furnace 1 used in the curing step or the like, and can prevent more effectively the aldehyde scavenger from scattering around. Further, because of the air curtain, the aldehyde scavenger can be permeated more efficiently even into the inside of the inorganic fiber mat 2, and the efficiency in adhesion of the aldehyde scavenger is improved. As a result, it is possible to produce an inorganic fiber mat capable of suppressing the release of the aldehyde scavenger.

EXAMPLES

Hereinafter, the present invention is described in more detail by way of examples. It should be noted that in the following examples, an aqueous solution containing, at a concentration of 10%, a combination of sodium sulfite and hydrazide compounds at a weight ratio of 1 to 4, the hydrazide compounds having 80 parts by mass of dihydrazide succinate and 20 parts by mass of dihydrazide adipate, was used as an aldehyde scavenger. In addition, a device illustrated in FIG. 1 and FIG. 2 was used as an aldehyde scavenger application device.

Test Example 1

Glass wool was used as an inorganic fiber, and there was used, as a binder, a composition obtained by adding 0.2 part by mass of aminosilane and 1 part by mass of ammonium sulfate to 100 parts by mass of a mixture containing a resol-type phenolic resin and a urea resin at a ratio of 70 to 30. The binder was applied to the glass wool so that the adhesion amount of the binder reaches 9.5 mass % with respect to the mass % of an inorganic fiber mat as the mass standard, and then the binder was heat-cured to yield an inorganic fiber mat having a thickness of 100 mm and a density of 9 kg/m$^3$.

The aldehyde scavenger was applied to the inorganic fiber mat immediately after the heat-curing of the binder under the conditions shown in Table 1 to yield an inorganic fiber mat. Table 1 also shows the scattering state of the aldehyde scavenger, the dry state of the surface of the resultant inorganic fiber mat, and the release amount (μg/m$^2$·h) of formaldehyde based on JIS A 1901 Small Chamber Method. It should be noted that the scattering state of the aldehyde scavenger was evaluated based on the following criteria. That is, the symbol ○ means that a small amount of the aldehyde scavenger scatters, the symbol Δ means that the aldehyde scavenger scatters to an extent by which no particular problem is caused, and the symbol x means that a large amount of the aldehyde scavenger scatters, causing an obstacle to a working environment or the like. Further, the dry state of the surface was evaluated based on the following criteria. That is, the symbol ○ means sufficiently dry, the symbol Δ means slightly damp, and the symbol x means wet.

It should be noted that Examples 6, 7, 8 were performed when changing the scavenger with other kinds. An inorganic fiber mat was produced in Example 6 in the same manner as that in Example 1 except that an aqueous solution containing, at a concentration of 10%, a combination of 100 parts by mass of carbodihydrazide, 60 parts by mass of dihydrazide adipate, and 40 parts by mass of dihydrazide succinate was used. An inorganic fiber mat was produced in Example 7 in the same manner as that in Example 6 except that the spray amount of the scavenger was changed to 5 g/m$^2$. An inorganic fiber mat was produced in Example 8 in the same manner as that in Example 6 except that an aqueous solution containing, at a concentration of 10%, a combination of 100 parts by mass of carbodihydrazide, 10 parts by mass of dihydrazide adipate, 5 parts by mass of dihydrazide succinate, and 0.1 part by mass of sodium sulfite was used.

TABLE 1

| | | Example 1 | Comparative Example 1 | Comparative Example 2 | Example 6 | Example 7 | Example 8 |
|---|---|---|---|---|---|---|---|
| Line speed (m/min) | | 50 | 50 | 50 | 50 | 50 | 50 |
| Aldehyde scavenger | Spray amount (liquid amount: g/m$^2$) | 8 | 8 | 0 | 8 | 5 | 8 |
| | Average diameter of droplets (μm) | 10 | 10 | — | 10 | 10 | 10 |
| Spray nozzle 4 | *1Height (mm) | 250 | 250 | No use | 250 | 250 | 250 |
| | *2Nozzle angle (degree) | 15 | 10 | No use | 15 | 15 | 15 |
| Suction device 6 | Air velocity (m/sec) | 1.7 | No use | No use | 1.7 | 1.7 | 1.7 |
| | Air volume (m$^3$/sec) | 4.2 | No use | No use | 4.2 | 4.2 | 4.2 |
| Air nozzle 5 | *1Height (mm) | 250 | No use | No use | 250 | 250 | 250 |
| | *2Nozzle angle (degree) | 45 | No use | No use | 45 | 45 | 45 |
| Scattering state of aldehyde scavenger | | ○ | x | — | ○ | ○ | ○ |
| Dry state of inorganic fiber mat | | ○ | x | — | ○ | ○ | ○ |
| Release amount of formaldehyde (μg/m$^2$/h) | | 2 | 3.5 | 4 | 1 | 2 | 1 |

*1a distance from the surface of an inorganic fiber mat.

*2an angle leaned toward the direction in which an inorganic fiber mat is conveyed when the downward direction in which is positioned vertically is defined as 0°.

In the inorganic fiber mat of Example 1 which was produced by spraying the aldehyde scavenger on the front side of an inorganic fiber mat and applying the aldehyde scavenger by performing suction from the back side of the inorganic fiber mat in the downstream side of the site where spraying was performed, the release of formaldehyde was extremely suppressed. Further, the inorganic fiber mat was sufficiently dry even though drying was not performed. In addition, when the aldehyde scavenger was sprayed, the aldehyde scavenger scarcely scattered around, and hence a working environment was satisfactory.

Test Example 2

Glass wool was used as an inorganic fiber, and there was used, as a binder, a composition obtained by adding 0.2 part by mass of aminosilane and 1 part by mass of ammonium sulfate to 100 parts by mass of a mixture containing a resol-type phenolic resin and a urea resin at a ratio of 70 to 30. The binder was applied to the glass wool so that the adhesion amount of the binder reaches 9.5 mass % with respect to the mass % of an inorganic fiber mat as the mass standard, and then the binder was heat-cured to yield an inorganic fiber mat having a thickness of 50 mm and a density of 32 kg/m$^3$.

The aldehyde scavenger was applied to the inorganic fiber mat immediately after the heat-curing of the binder under the conditions shown in Table 2 to yield an inorganic fiber mat. Table 2 also shows the scattering state of the aldehyde scavenger, the dry state of the surface of the resultant inorganic fiber mat, and the release amount (μg/m$^2$·h) of formaldehyde based on JIS A 1901 Small Chamber Method.

TABLE 2

| | | Example 2 | Example 3 | Comparative Example 3 | Comparative Example 4 |
|---|---|---|---|---|---|
| | Line speed (m/min) | 20 | 20 | 20 | 20 |
| Aldehyde scavenger | Spray amount (liquid amount: g/m$^2$) | 15 | 15 | 15 | 30 |
| | Average diameter of droplets (μm) | 10 | 10 | 10 | 15 |
| Spray nozzle 4 | *1Height (mm) | 200 | 200 | 200 | 200 |
| | *2Nozzle angle (degree) | 45 | 45 | 45 | 45 |
| Suction device 6 | Air velocity (m/sec) | 1.3 | 1.3 | No use | No use |
| | Air volume (m$^3$/sec) | 1.7 | 1.7 | No use | No use |
| Air nozzle 5 | *1Height (mm) | 250 | No use | No use | No use |
| | *2Nozzle angle (degree) | 45 | No use | No use | No use |
| Scattering state of aldehyde scavenger | | ○ | ○ | x | x |
| Dry state of inorganic fiber mat | | ○ | Δ | x | x |
| Release amount of formaldehyde (μg/m$^2$/h) | | 2 | 4 | 5.5 | 4.5 |

*1a distance from the surface of an inorganic fiber mat.

*2an angle leaned toward the direction in which an inorganic fiber mat is conveyed when the downward direction in which is positioned vertically is defined as 0°.

In the inorganic fiber mats of Examples 2 and 3 which were produced by spraying the aldehyde scavenger on the front side of an inorganic fiber mat and applying the aldehyde scavenger by performing suction from the back side of the inorganic fiber mat in the downstream side of the site where spraying was performed, the release of formaldehyde was suppressed. Further, the inorganic fiber mats were sufficiently dry even though drying was not performed. In addition, when the aldehyde scavenger was sprayed, the aldehyde scavenger scarcely scattered around, and hence a working environment was satisfactory. In particular, in Example 2 in which the aldehyde scavenger was sprayed while an air curtain was formed by blowing air from the air nozzles 5, the scattering of the aldehyde scavenger was able to be particularly suppressed. Further, the aldehyde scavenger efficiently adhered to the inorganic fiber mat, and hence the release of formaldehyde was extremely suppressed.

Test Example 3

Glass wool was used as an inorganic fiber, and there was used, as a binder, a composition obtained by adding 0.2 part by mass of aminosilane and 1 part by mass of ammonium sulfate to 100 parts by mass of a mixture containing a resol-type phenolic resin and a urea resin at a ratio of 70 to 30. The binder was applied to the glass wool so that the adhesion amount of the binder reaches 9.5 mass % with respect to the mass % of an inorganic fiber mat as the mass standard, and then the binder was heat-cured to yield an inorganic fiber mat having a thickness of 50 mm and a density of 32 kg/m$^3$. Then, a glass fiber nonwoven fabric having a size of 30 cm by 30 cm (fiber density: 100 g/m$^2$) was fed onto the inorganic fiber mat, and the aldehyde scavenger was applied under the conditions shown in Table 3. The resultant 50 pieces of glass fiber nonwoven fabrics were dried at 110° C. for 30 minutes. Each of the glass fiber nonwoven fabrics was measured for a change in weight by calculating the increased value based on the original weight of each of the glass fiber nonwoven fabrics before the application of the aldehyde scavenger. Then, the average of the changed values in weight of respective glass fiber nonwoven fabrics was determined. Table 3 also shows the changes in weight of the glass fiber nonwoven fabrics of respective examples.

TABLE 3

| | | Example 4 | Example 5 | Comparative Example 5 |
|---|---|---|---|---|
| Line speed (m/min) | | 20 | 20 | 20 |
| Aldehyde scavenger | Spray amount (liquid amount: g/m$^2$) | 30 | 30 | 30 |
| | Average diameter of droplets (μm) | 15 | 15 | 15 |
| Spray nozzle 4 | *1Height (mm) | 200 | 200 | 200 |
| | *2Nozzle angle (degree) | 45 | 45 | 45 |
| Suction device 6 | Air velocity (m/sec) | 1.3 | 1.3 | No use |
| | Air volume (m$^3$/sec) | 1.7 | 1.7 | No use |
| Air nozzle 5 | *1Height (mm) | 250 | No use | No use |
| | *2Nozzle angle (degree) | 45 | No use | No use |
| Average of changed values in weight of glass fiber nonwoven fabrics (g) | | 0.24 | 0.22 | 0.15 |

*1a distance from the surface of an inorganic fiber mat.

*2an angle leaned toward the direction in which an inorganic fiber mat is conveyed when the downward direction in which is positioned vertically is defined as 0°.

In Examples 4 and 5 in which suction was performed from the back surface side of the glass fiber nonwoven fabric in the downstream side of the site where the aldehyde scavenger was sprayed, the change in weight was large and the adhesion amount of the aldehyde scavenger was much more, when compared with Comparative Example 5 in which no suction was performed. The result shows that performing suction leads to the increased adhesion amount of the aldehyde scavenger to the glass fiber nonwoven fabric, resulting in a reduction in the scattering amount of the aldehyde scavenger in a sense of indirect manner. In example 4 in which the aldehyde scavenger was sprayed while an air curtain was formed by blowing air from the air nozzles 5, the change in weight after the application of the aldehyde scavenger was large, and the adhesion amount of the aldehyde scavenger was much, and hence the scattering of the aldehyde scavenger was able to be suppressed better.

Figure 1:
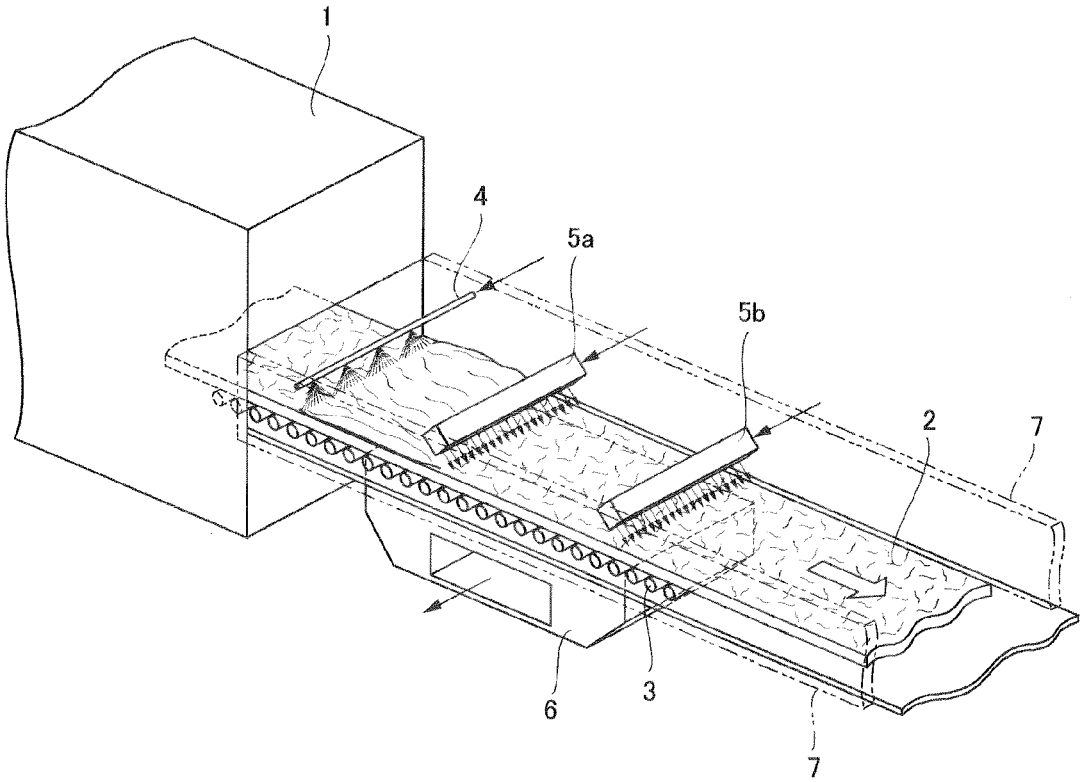
FIG. 1 is a perspective view of an aldehyde scavenger application device used in an aldehyde scavenger application step in a method of producing an inorganic fiber mat of the present invention.
Figure 2:
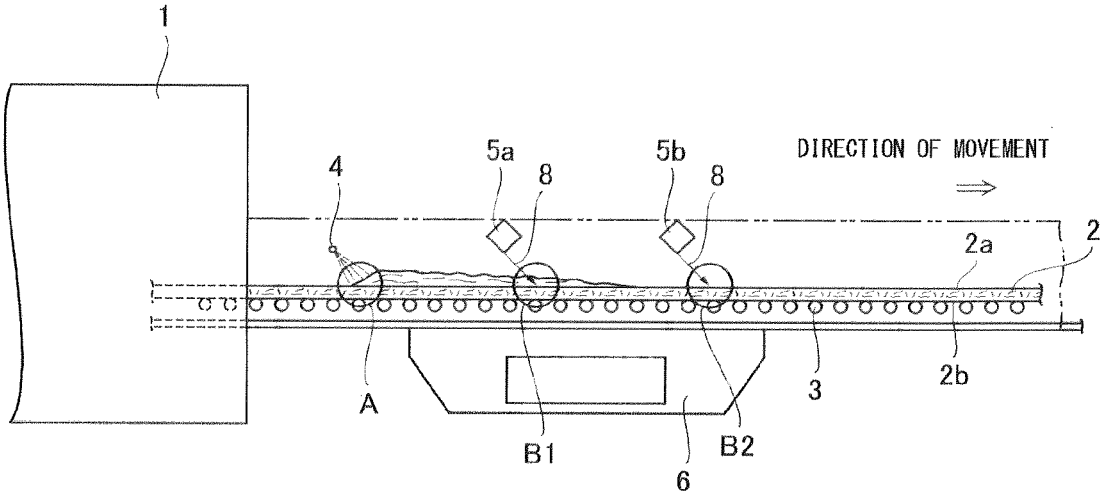
FIG. 2 is a front view of the aldehyde scavenger application device.
Figure 3:
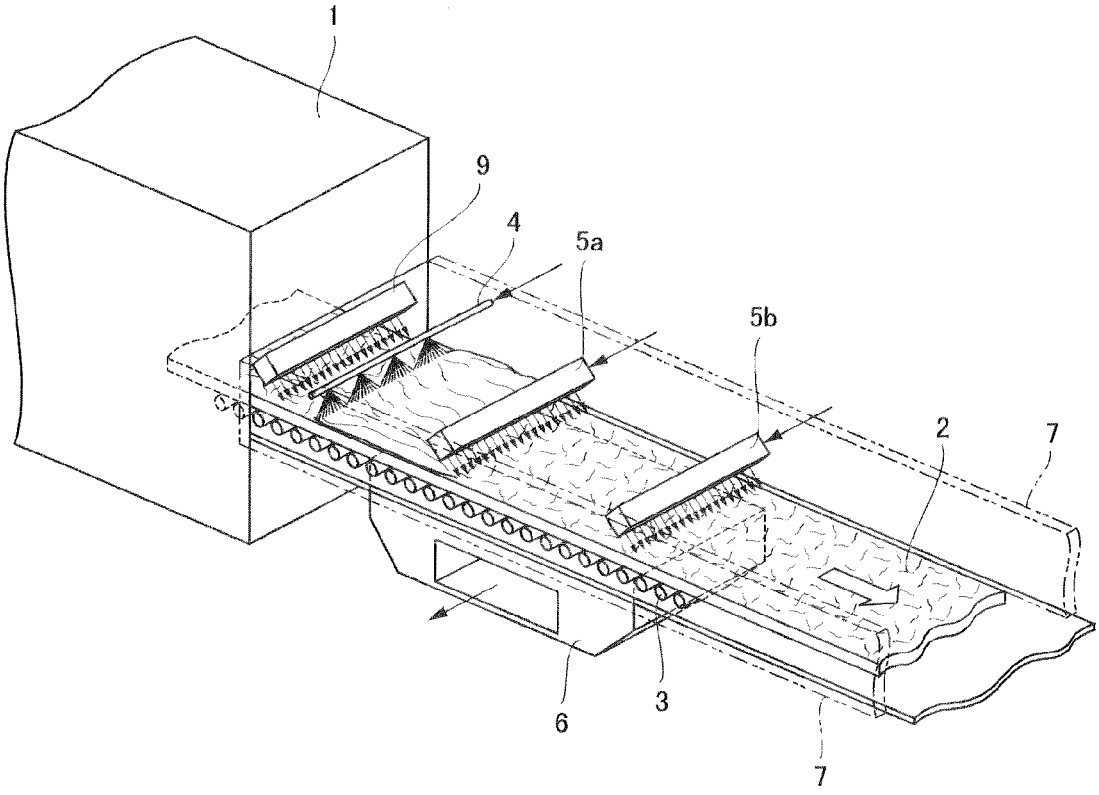
FIG. 3 is a perspective view of a second embodiment of an aldehyde scavenger application device used in the aldehyde scavenger application step in the method of producing an inorganic fiber mat of the present invention.

| Description of Symbols | |
|---|---|
| 1: | heating furnace |
| 2: | inorganic fiber mat |
| 3: | conveyor line |
| 4: | spray nozzle |
| 5a, 5b: | air nozzle |
| 6: | suction device |
| 7: | partition plate |
| 8: | air curtain |
| 9: | second air nozzle |

The invention claimed is:

1. A method of producing an inorganic fiber mat, the method comprising:

a fiber collection step of applying a binder to inorganic fibers and accumulating in a mat shape on a conveyor line to form an inorganic fiber web;

a binder-curing step of heat-curing the binder applied to the inorganic fiber web to form an inorganic fiber mat; and an aldehyde scavenger application step of applying an aldehyde scavenger to the inorganic fiber mat, wherein the aldehyde scavenger application step involves spraying the aldehyde scavenger in a form of droplets having an average diameter of 1 to 50 μm on a front side of the inorganic fiber mat, wherein the aldehyde scavenger application step involves forming an air curtain by blowing a gas from a discharge opening of an air nozzle leaning towards the direction in which the inorganic fiber mat is forwarded on the front side of the inorganic fiber mat in a downstream side of a site where the aldehyde scavenger is sprayed on the conveyor line for the inorganic fiber mat, and wherein the aldehyde scavenger application step involves performing suction from a back side of the inorganic fiber mat just below a site where the air curtain is formed.

2. A method of producing an inorganic fiber mat according to claim 1, the spraying of the aldehyde scavenger is performed in a downstream side of the site where the binder-curing is performed on the conveyor line for the inorganic fiber mat.

3. A method of producing an inorganic fiber mat according to claim 1, wherein the aldehyde scavenger application step involves forming an air curtain by blowing a gas on the front side of the inorganic fiber mat in an upstream side of the site where the aldehyde scavenger is sprayed on the conveyor line for the inorganic fiber mat.

4. A method of producing an inorganic fiber mat according to claim 1, wherein the aldehyde scavenger application step involves forming the air curtain by blowing hot air on the front side of the inorganic fiber mat.

5. A method of producing an inorganic fiber mat according to claim 1, wherein the aldehyde scavenger application step involves applying the aldehyde scavenger in a state where partition plates are arranged along both side edge portions of the conveyor line for the inorganic fiber mat.

6. A method of producing an inorganic fiber mat according to claim 1, wherein an aqueous composition having a solid content of 5 to 40% is used as the aldehyde scavenger.

7. A method of producing an inorganic fiber mat according to claim 1, wherein the aldehyde scavenger comprises (1) carbodihydrazide and (2) at least one compound selected from the group consisting of dihydrazide adipate, dihydrazide succinate, sodium sulfite, and sodium hydrogen sulfite, and the contents of components other than carbodihydrazide in the aldehyde scavenger, with respect to 100 parts by mass of carbodihydrazide, are 5 to 60 parts by mass of dihydrazide adipate, 5 to 40 parts by mass of dihydrazide succinate, 0 to 5 parts by mass of sodium sulfite, and 0 to 5 parts by mass of sodium hydrogen sulfite.

8. A method of producing an inorganic fiber mat according to claim 1, wherein the aldehyde scavenger comprises (1) carbodihydrazide, (2) dihydrazide adipate and/or dihydrazide succinate, and (3) sodium sulfite and/or sodium hydrogen sulfite, and contents of the components other than carbodihydrazide in the aldehyde scavenger, with respect to 100 parts by mass of carbodihydrazide, are 5 to 19 parts by mass of dihydrazide adipate and/or dihydrazide succinate, 0.1 to 5 parts by mass of sodium sulfite and/or sodium hydrogen sulfite.

9. A method of producing an inorganic fiber mat according to claim 2, wherein the aldehyde scavenger application step involves forming an air curtain by blowing a gas on the front side of the inorganic fiber mat in an upstream side of the site where the aldehyde scavenger is sprayed on the conveyor line for the inorganic fiber mat.

10. A method of producing an inorganic fiber mat according to claim 1, wherein the discharge opening of the air nozzle leans by 30 to 60° toward the direction in which the inorganic fiber mat is forwarded when the downward direction in which the discharge opening is positioned vertically is defined as 0°.

11. A method of producing an inorganic fiber mat according to claim 1, wherein the discharge opening of the air nozzle leans by 30 to 45° toward the direction in which the inorganic fiber mat is forwarded when the downward direction in which the discharge opening is postioned vertically is defined as 0°.

12. A method of producing an inorganic fiber mat according to claim 2, wherein the aldehyde scavenger application step involves forming the air curtain by blowing hot air on the front side of the inorganic fiber mat.

13. A method of producing an inorganic fiber mat according to claim 2, wherein the aldehyde scavenger application step involves applying the aldehyde scavenger in a state where partition plates are arranged along both side edge portions of the conveyor line for the inorganic fiber mat.

14. A method of producing an inorganic fiber mat according to claim 3, wherein the aldehyde scavenger application step involves forming the air curtain by blowing hot air on the front side of the inorganic fiber mat.

15. A method of producing an inorganic fiber mat according to claim 3, wherein the aldehyde scavenger application step involves applying the aldehyde scavenger in a state where partition plates are arranged along both side edge portions of the conveyor line for the inorganic fiber mat.

16. A method of producing an inorganic fiber mat according to claim 9, wherein the aldehyde scavenger application step involves forming the air curtain by blowing hot air on the front side of the inorganic fiber mat.

17. A method of producing an inorganic fiber mat according to claim 9, wherein the aldehyde scavenger application step involves applying the aldehyde scavenger in a state where partition plates are arranged along both side edge portions of the conveyor line for the inorganic fiber mat.

* * * * *